US006019362A

United States Patent [19]

Yazawa

[11] Patent Number: 6,019,362

[45] Date of Patent: Feb. 1, 2000

[54] SHEET TRANSFER APPARATUS

[75] Inventor: Hiroaki Yazawa, Nagoya, Japan

[73] Assignee: Brother Kogyo Kabushiki Kaisha, Nagoya, Japan

[21] Appl. No.: 09/021,810

[22] Filed: Feb. 11, 1998

[30] Foreign Application Priority Data

Feb. 13, 1997 [JP] Japan ..... 9-028244

[51] Int. Cl.[7] ..... B65H 5/22

[52] U.S. Cl. ..... 271/4.01; 271/4.03; 271/4.08; 271/110; 271/121; 271/258.01; 271/256

[58] Field of Search ..... 271/4.01, 4.03, 271/4.08, 4.1, 10.09, 10.11, 110, 121, 258.01, 259, 265.01, 265.02, 256

[56] References Cited

U.S. PATENT DOCUMENTS 4,768,771 9/1988 May ..... 271/121
5,201,508 4/1993 Kuo ..... 271/110
5,295,675 3/1994 Hain ..... 271/121
5,615,873 4/1997 Kobayashi et al. ..... 271/121
5,630,579 5/1997 Minami et al. ..... 271/4.1
5,662,320 9/1997 Fujiwara et al. ..... 271/4.1

*Primary Examiner*—H. Grant Skaggs
*Attorney, Agent, or Firm*—Oliff & Berridge, PLC

[57] ABSTRACT

A sheet transfer apparatus includes a sheet receiver for receiving a plurality of sheets, and a transfer mechanism for successively transferring each of the sheets from the sheet receiver along a predetermined transfer path. The sheet receiver has an openable member which is movable between an open position and a closed position. The sheet transfer apparatus further includes a detecting device provided at a predetermined position in the transfer path for detecting a transfer state of each transferred sheet and for detecting an open/closed state of the openable member, and a controller for determining whether the detecting device is detecting the transfer state of each transferred sheet or the open/closed state of the openable member.

20 Claims, 10 Drawing Sheets

SHEET TRANSFER APPARATUS

BACKGROUND OF THE INVENTION

1. Field of the Invention

The present invention relates to a sheet transfer apparatus which is incorporated in a facsimile machine for example for successively transferring each of document papers or recording papers for example.

2. Description of the Related Art

A facsimile machine is known which includes a recording paper receiver for receiving a stack of recording papers (cut paper sheets), and a transfer mechanism for successively transferring each of the papers along a predetermined transfer path. The paper receiver has an openable lid member which is pivotally movable between an open position and a closed position. The lid member normally assumes the closed position but may be pivoted open for introducing a new stack of recording papers or for removing a jammed paper.

In such a facsimile machine, when the lid member is pivoted open (which is an abnormal state), it is necessary to prohibit the transfer mechanism from operating. For this purpose, a separate detector is provided for detecting the open/closed position of the lid member in addition to sheet transfer detectors for detecting the presence or absence of the recording paper. The sheet transfer detectors are utilized for watching a paper jam (which is another abnormal state) whereby the transfer mechanism is also prohibited from operating. Thus, the need to provide the separate detector exclusively for the lid member increases the total number of required detectors, thereby resulting a production cost increase.

On the other hand, after removing a cause for the abnormality, it has been conventionally necessary to push a separate reset button or to open and close a separate cover provided on the housing body of the facsimile machine. Thus, the step of pushing the reset button or of opening and closing the cover is an additional step which detracts from the utility or convenience of the facsimile machine. Further, when the cause for the abnormality can be removed simply by pivotally opening the lid member of the sheet receiver, the step of opening and closing the cover of the housing body is a useless but indispensable step, which step may only cause a positional deviation of an ink ribbon.

SUMMARY OF THE INVENTION

It is, therefore, an object of the present invention is to provide a sheet transfer apparatus which is capable of reducing the number of sensors or detectors required for detecting an abnormality associated with sheet transfer or feed.

Another object of the present invention is to provide a sheet transfer apparatus which is capable of readily canceling a sheet transfer prohibition state after removal of a cause for the abnormality.

According to one aspect of the present invention, there is provided a sheet transfer apparatus comprising: a sheet receiver for receiving a sheet, the sheet receiver including an openable member which is movable between an open position and a closed position; a transfer mechanism for transferring the sheet from the sheet receiver along a predetermined transfer path; a detecting device provided at a predetermined position in the transfer path for detecting a transfer state of the transferred sheet and for detecting an open/closed state of the openable member; and a controller for determining whether the detecting device is detecting the transfer state of the transferred sheet or the open/closed state of the openable member.

With the arrangement described above, since the detecting device serves dually to detect the transfer state of the transferred sheet and the open/closed state of the openable member, it is unnecessary to provide a separate detecting device for exclusively detecting the open/closed state of the openable member. Thus, the total number of detecting devices required for watching the operation of the sheet transfer apparatus may be reduced.

The sheet to be transferred by the sheet transfer apparatus of the present invention may be a paper (e.g. a plain recording paper, a thermosensitive paper, or a document paper) or a resin film. Further, the transfer mechanism may typically comprise a stepping motor, a reduction gear mechanism, and a plurality of rollers connected to the stepping motor through the reduction gear mechanism.

According to a preferred embodiment of the present invention, the detecting device comprises a first lever pivotally supported for engagement with the transferred sheet, a second lever pivotally supported for engagement with the first lever and the openable member, and a switch associated with the first lever for turning on and off in response to pivotal movement of the first lever. Typically, the switch may be a photoelectric switch or a proximity switch.

Preferably, the first lever may carry an engaging pin, whereas the second lever may have a guide wall for engagement with the engaging pin of the first lever. As result, the engaging pin prevents the second lever from unexpectedly pivoting when the first lever is first pivoted by the transferred sheet.

The openable member may preferably be a sheet discharge tray which is pivotable between the open position and the closed position, whereas the sheet receiver may also include a sheet feed tray which defines a sheet insertion space in combination with the sheet discharge tray which is pivoted to the closed position. Thus, when the sheet discharge tray is pivoted open, it is possible to introduce a new stack of sheets into the sheet insertion space or to utilize the sheet insertion space for removing a jammed sheet when the sheet is jammed at or near the entrance of the sheet transfer path.

Preferably, the controller may comprises an abnormality determiner for detecting an abnormality on the basis of a detection signal from the detecting device and a drive state of the transfer mechanism, a transfer prohibitor for prohibiting the transfer mechanism from operating when the abnormality determiner detects the abnormality, and a prohibition canceler for allowing the transfer mechanism to operate upon closing the openable member after removal of a cause for the abnormality.

Typically, the controller may be a central processing unit of a facsimile machine, whereas the sheet transfer apparatus may forma printing unit of the facsimile machine.

According to another aspect of the present invention, there is provided a sheet transfer apparatus comprising: a sheet receiver for receiving a sheet, the sheet receiver including an openable member which is movable between an open position and a closed position; a transfer mechanism for transferring the sheet from the sheet receiver along a predetermined transfer path, the transfer mechanism including a platen roller provided at an intermediate position of the transfer path; a first detecting device provided in the transfer path upstream from the platen roller for detecting a transfer state of the transferred sheet, the first detecting device being connected to the openable member for detecting an open/closed state of the openable member; a second detecting device provided in the transfer path downstream from the platen roller for detecting a transfer state of the transferred sheet; and a controller for detecting an abnormality on the basis of detection signals from the first and second detecting devices and a drive state of the transfer mechanism, the controller prohibiting the transfer mechanism from operating upon detection of the abnormality, the controller further allowing the transfer mechanism to operate upon closing the openable member after removal of a cause for the abnormality.

According to a further aspect of the present invention, there is provided a sheet transfer apparatus comprising: a sheet receiver for receiving a sheet, the sheet receiver including an openable member which is movable between an open position and a closed position; a transfer mechanism for transferring the sheet from the sheet receiver along a predetermined transfer path; a first detecting device for detecting an open/closed state of the openable member; a second detecting device for detecting a transfer state of the transferred sheet; and a controller for detecting an abnormality on the basis of detection signals from the first and second devices and a drive state of the transfer mechanism, the controller prohibiting the transfer mechanism from operating upon detection of the abnormality, the controller further allowing the transfer mechanism to operate upon closing the openable member after removal of a cause for the abnormality Other objects, features and advantages of the present invention will be apparent from the detailed description of a preferred embodiment given below with reference to the accompanying drawings.

DETAILED DESCRIPTION OF THE PREFERRED EMBODIMENT

The preferred embodiment of the present invention will be described below with reference to the accompanying drawings.

Figure 1:
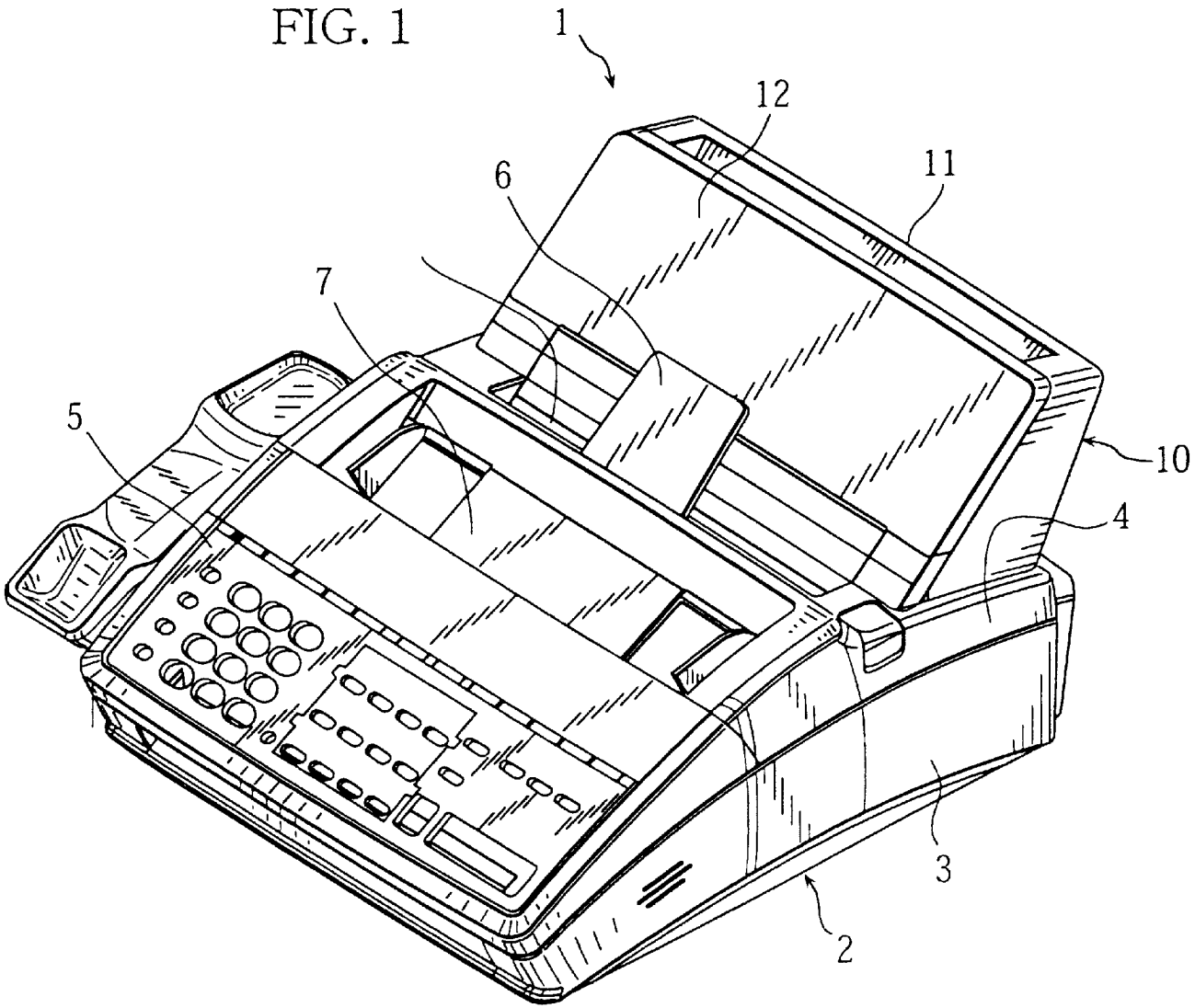
FIG. 1 is a perspective view showing a facsimile machine which incorporates a sheet transfer apparatus embodying the present invention.
Figure 2:
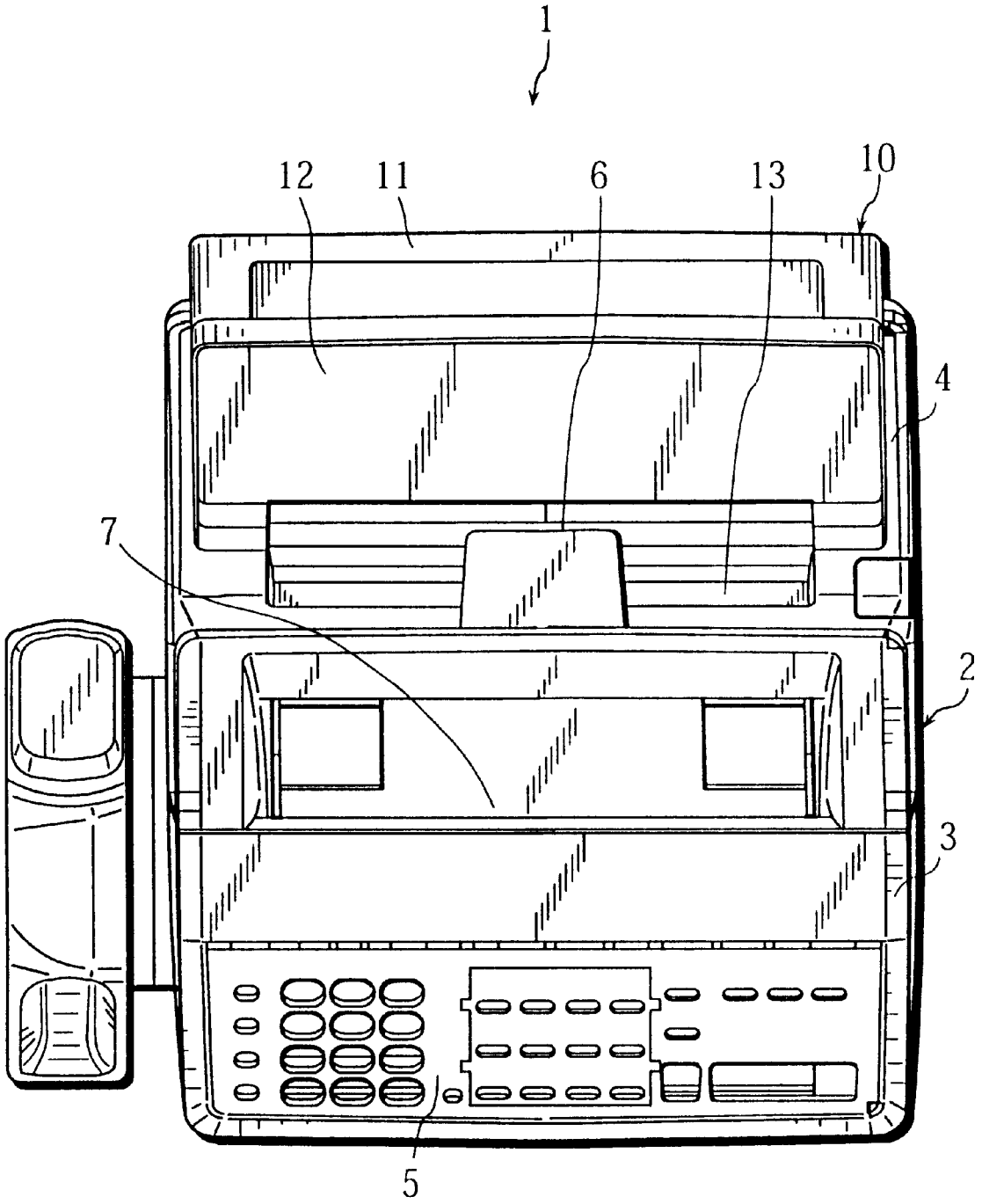
FIG. 2 is a plan view showing the same facsimile machine.
Figure 3:
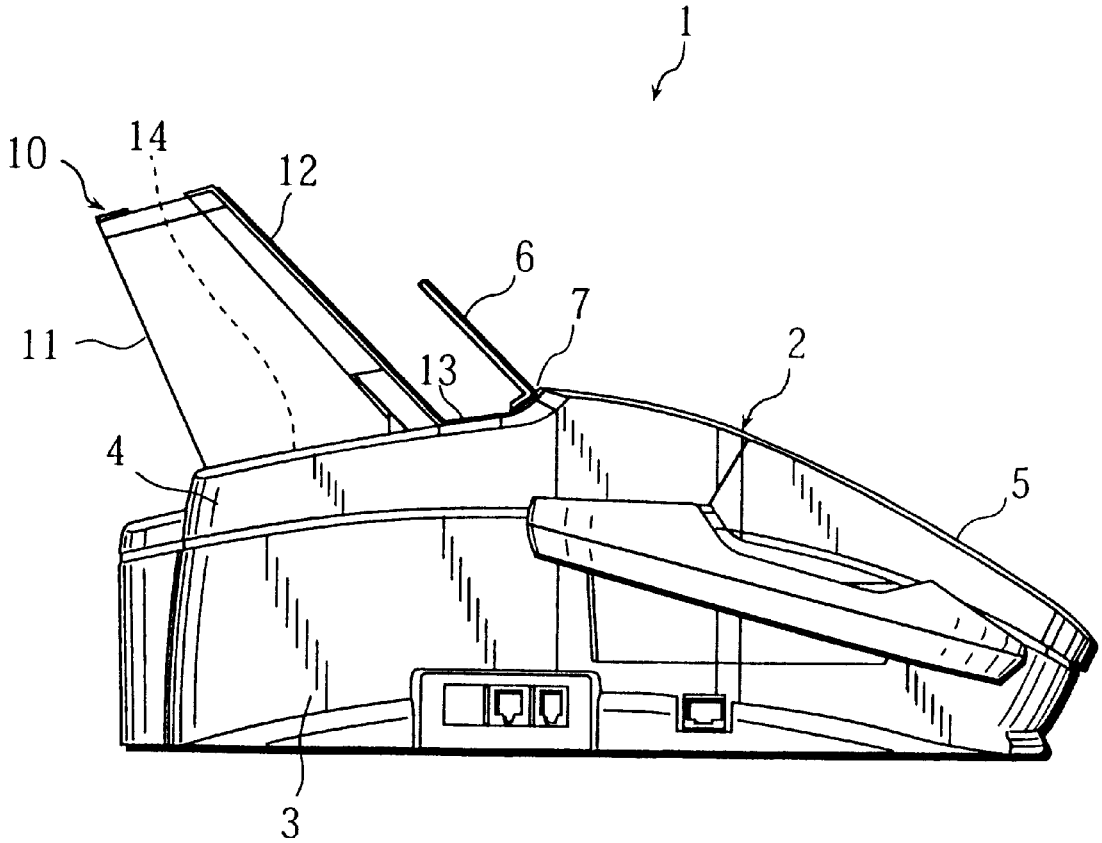
FIG. 3 is a side view showing the same facsimile machine.

FIGS. 1 through 3 of the accompanying drawings represent an overall view of a facsimile machine which incorporates a sheet transfer apparatus embodying the present invention. The facsimile machine generally represented by reference numeral 1 comprises a housing 2 which includes a main housing body 3 and a rear cover 4 mounted pivotally on the main housing body 3. The housing 2 also includes a front operation/display panel 5 which carries key switches and liquid crystal display devices. The front panel 5 may be also mounted pivotally on the main housing body 3.

Figure 4:
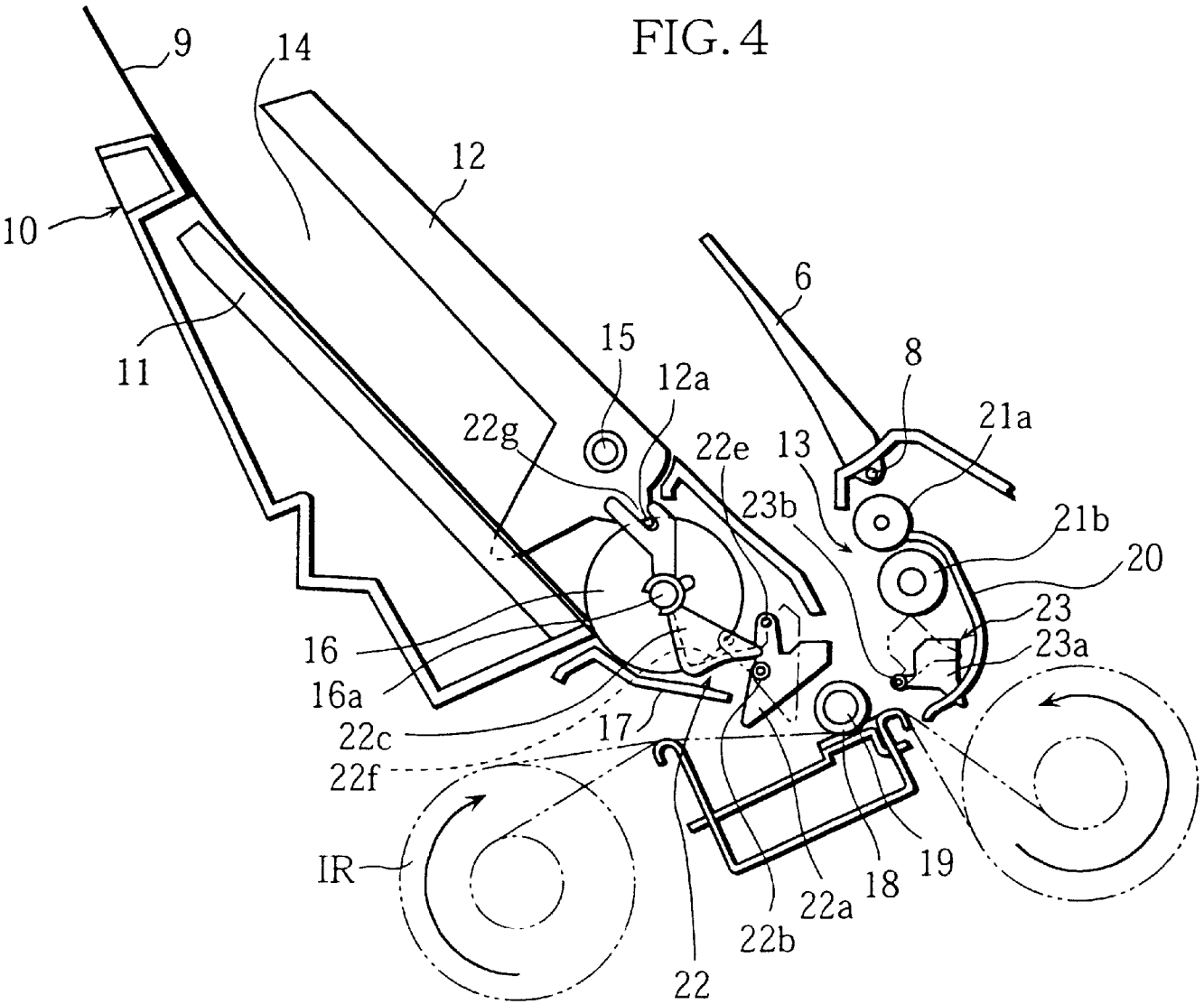
FIG. 4 is a slightly enlarged schematic view showing the sheet transfer apparatus of the same facsimile machine as viewed from one side thereof.

The housing 2 is provided with a document paper feed tray 6 for supporting a stack of document papers (not shown) in position for feeding through a document paper inlet 7. The document paper feed tray 6 is pivotally supported on the rear cover 4 by a pin 8, as shown in FIG. 4. Normally, the document paper feed tray 6 assumes an inclined posture but is pivotable forwardly toward the front panel 5.

The rear cover 4 also supports a recording paper receiver 10 which is rectangular in horizontal unit. As shown in FIG. 4, the recording paper receiver 10 includes a recording paper feed tray 11 which is inclined similarly to the document paper feed tray 6 for supporting a stack of recording papers 9 (only one shown in FIG. 4) in position for feeding, and a recording paper discharge tray 12 which is also inclined similarly to the document paper feed tray 6 for successively receiving each of the recording papers 9 which has passed through a recording paper outlet 13 after printing. The recording paper feed tray 11 and the recording paper discharge tray 12 are joined together to define a recording paper insertion space 14 for accepting the stack of recording papers. Further, the recording paper feed tray 11 is pivotally supported on the rear cover 4 by a pin 15.

Since the sheet transfer apparatus according to the present invention is provided only for transferring each of the recording papers 9 in the illustrated embodiment, the sheet transfer apparatus for transferring the document papers is not described hereinafter. However, the present invention is also applicable to the sheet transfer apparatus for transferring the document papers.

As shown in FIG. 4, each of the blank recording papers 9 supported by the recording paper feed tray 11 is successively fed into the housing 2 by a feed roller 16. At this time, a separating segment 17 held against the feed roller 25 prevents two or more of the recording papers from being erroneously fed together.

The blank recording paper 9 thus fed into the housing 2 enters between a printhead 18 and a platen roller 19, so that the printhead 18 prints, line by line, images onto the recording paper according to the image signals transmitted to the printhead 18 while the platen roller 19 causes the recording paper to move line by line. At this time, an ink ribbon IR also enters between the printhead 18 and the platen roller 19 to supply ink as required for printing.

After passing between the printhead 18 and the platen roller 19, the printed recording paper 9 is U-turned by a guide member 20 and enters between a pair of discharge rollers 21*a*, 21*b* for discharging out of the housing 2 through the recording paper outlet 13. As a result, the printed recording paper 9 is received by the recording paper discharge tray 12.

As also shown in FIG. 4, a first detecting device 22 is provided for detecting the presence or absence of the recording paper 9 in a transfer path extending from the feed roller 16 to the printhead 18. The first detecting device 22 also has an additional function of determining the open or closed state of the recording paper discharge tray 12, as hereinafter described more in detail. Further, a second detecting device 23 is provided for detecting the presence or absence of the recording paper 9 in a transfer path extending from the printhead 19 to the pair of discharge rollers 21*a*, 21*b*.

The first detecting device 22 includes a first lever 22*a* pivotally supported on a pin 22*b*, and a second lever 22*c* supported on the shaft 16*a* of the feed roller 16 for pivoting independently of the feed roller 16, and a switch 22*d* (see FIG. 6) which is turned on and off in response to the pivotal movement of the first lever 22*a*. Typically, the switch 22*d* may be a reflection type photoelectric switch for detecting the movement of an actuator (not shown) which is mounted on the first lever 22*a*.

With the recording paper discharge tray 12 closed, the first lever 22*a* of the first detecting device 22 is initially spring-urged to assume an ON-position before the recording paper 9 reaches the first lever 22*a*, as indicated by solid lines in FIG. 4. When the recording paper 9 presses the first lever 22*a* for entry between the printhead 18 and the platen 19, the first lever 22*a* pivots counterclockwise to assume an OFF-position, as indicated by phantom lines in FIG. 4. The first lever 22*a* carries an engaging pin 22*e*.

Figure 10:
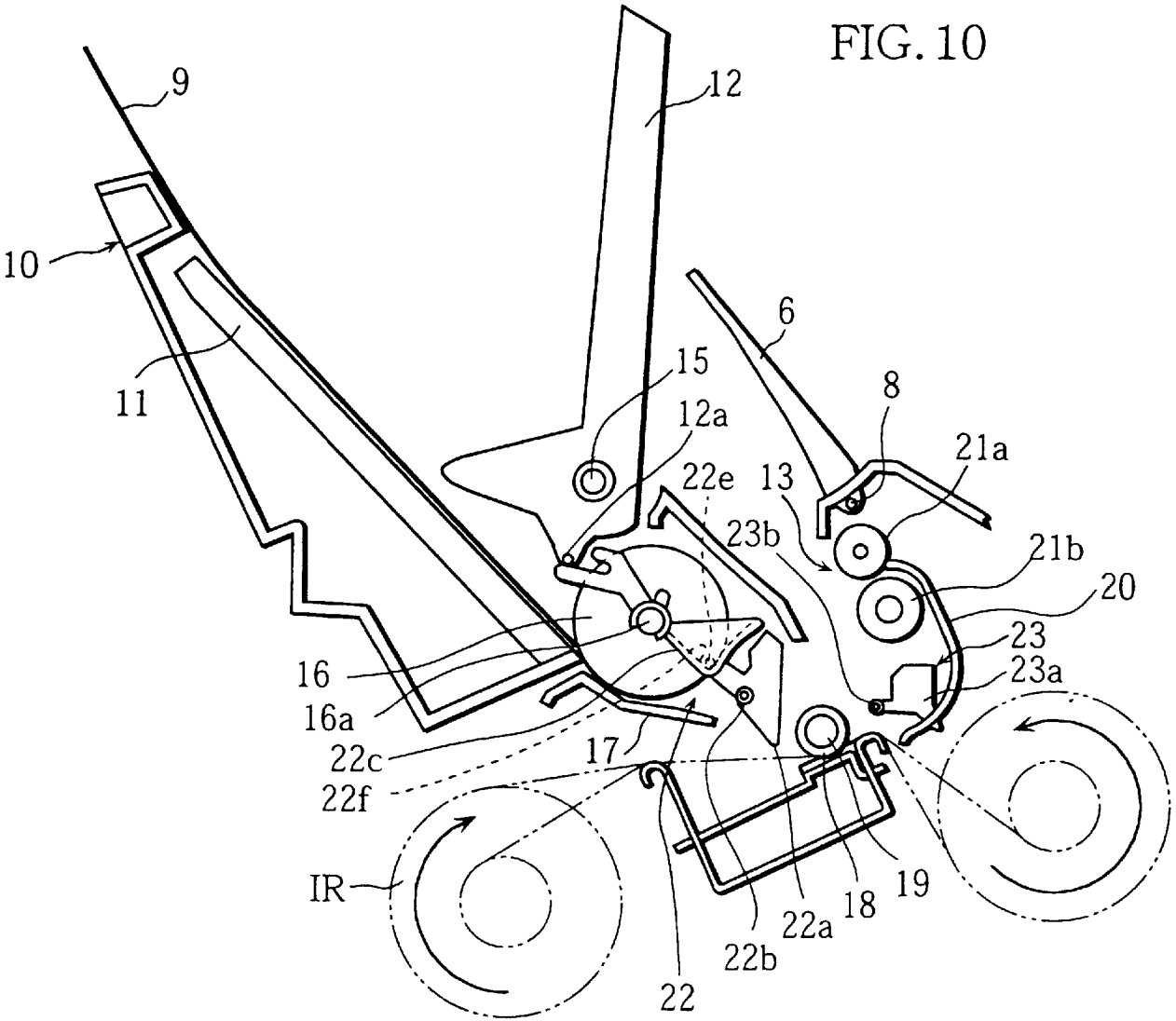
FIG. 10 is a schematic view again similar to FIG. 4 but showing the same sheet transfer apparatus with a recording paper discharge tray pivoted open.

On the other hand, the second lever 22*c* of the first detecting device 22 includes a lower arm having a guide wall 22*f* for guiding engagement with the engaging pin 22*e* of the first lever 22*a*, and an upper arm having a guide slot 22*g* for engagement with an engaging pin 12*a* provided at the lower end of the recording paper discharge tray 12. Thus, when the recording paper discharge tray 12 is pivoted forward to assume an open position (e.g. for introducing a new stack of recording papers into the recording paper insertion space 14 or for removing a jammed paper), the second lever 22*c* pivots counterclockwise to bring the guide wall 22*f* into guiding contact with the engaging pin 22*e* of the first lever 22*a* (see also FIG. 10). As a result, the first lever 22*a* also pivots counterclockwise to assume the OFF-position, as indicated by the phantom lines in FIG. 4.

In this way, the photoelectric switch 22*d* (FIG. 6) of the first detecting device 22 is turned off in two instances. First, the photoelectric switch 22*d* is turned off by the passage of the recording paper 9 beyond the first lever 22*a*. Secondly, the photoelectric switch 22*d* is also turned off by the opening pivotal movement of the recording paper discharge tray 12.

The second detecting device 23 includes a single lever 23*a* pivotally supported on a shaft 23*b*, and a switch 23*c* (see FIG. 6) which may be a reflection type photoelectric switch operatively associated with the lever 23*a*. Initially, the lever 23*a* is spring-urged to assume an ON-position before the recording paper 9 reaches this lever 23*a*, as indicated by solid lines in FIG. 4. When the recording paper 9 presses the lever 23*a* for movement along the guide member 20, the lever 23*a* pivots counterclockwise to assume an OFF-position, as indicated by phantom lines in FIG. 4.

Figure 5:
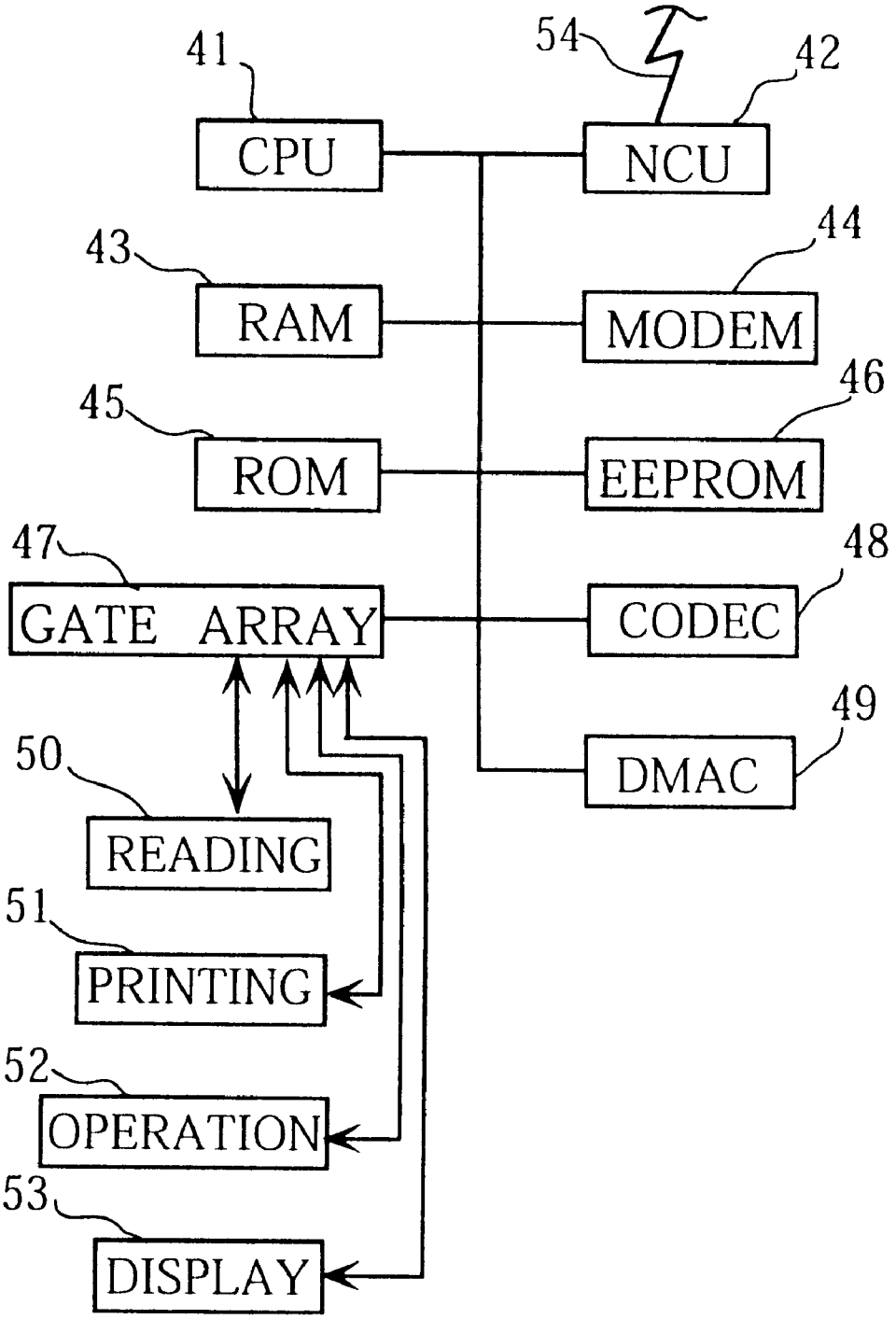
FIG. 5 is a block circuit diagram of the same facsimile machine.

Next, reference is made to FIG. 5 for describing the circuit arrangement of the facsimile machine.

As shown in FIG. 5, the facsimile machine comprises a CPU (central processing unit) 41, an NCU (network control unit) 42, a RAM (random access memory) 43, a modem (modulator-demodulator) 44, a ROM (read-only memory) 45, an EEPROM (electrically erasable and programmable ROM) 46, a gate array 47, a codec (coder-decoder) 48, and a DMAC (direct memory access controller) 49. Further, the facsimile machine also comprises a reading unit 50, a printing unit 51, an operation unit 52, and a display unit 53.

The CPU 41, the NCU 42, the RAM 43, the modem 44, the ROM 45, the EEPROM 46, the gate array 47, the codec 48 and the DMAC 49 are connected to each other via bus lines (digital lines). The bus lines include data bus lines, address bus lines and control signal bus lines. The gate array 47 is connected to the reading unit 50, the printing unit 51, the operation unit 52 and the display unit 53, respectively.

The CPU 41 provides an overall control of the facsimile machine as a whole.

The NCU 42 is connected to a telephone line 54 for providing network control. The NCU 42 is also connected to the modem 44 through an analog line.

The RAM 43 stores various digital data such as image data. Of course, an additional RAM or RAMs may be provided to increase the capacity of data storage.

The modem 44 modulates the transmitting codes and demodulates the received codes.

The ROM 45 stores various programs or the like as required for controlling the facsimile machine, whereas the EEPROM 46 stores registered data (e.g. shortcut dials) and/or flags.

The gate array 47 functions as an I/O interface (input/output interface) for the CPU 41 for data transmission to and/or from the reading unit 50, the printing unit 51, the operation unit 52 and the display unit 53.

The codec 48 performs coding of the transmitting image data and decoding of the received image data.

The DMAC 49 provides memory access control with respect to the RAM 43 for example.

The reading unit 50 reads out the image data from a document paper (not shown) for output through the gate array 47. In the illustrated embodiment, the reading unit 50 has nothing to do with the gist of the present invention and therefore is not described in detail.

Figure 6:
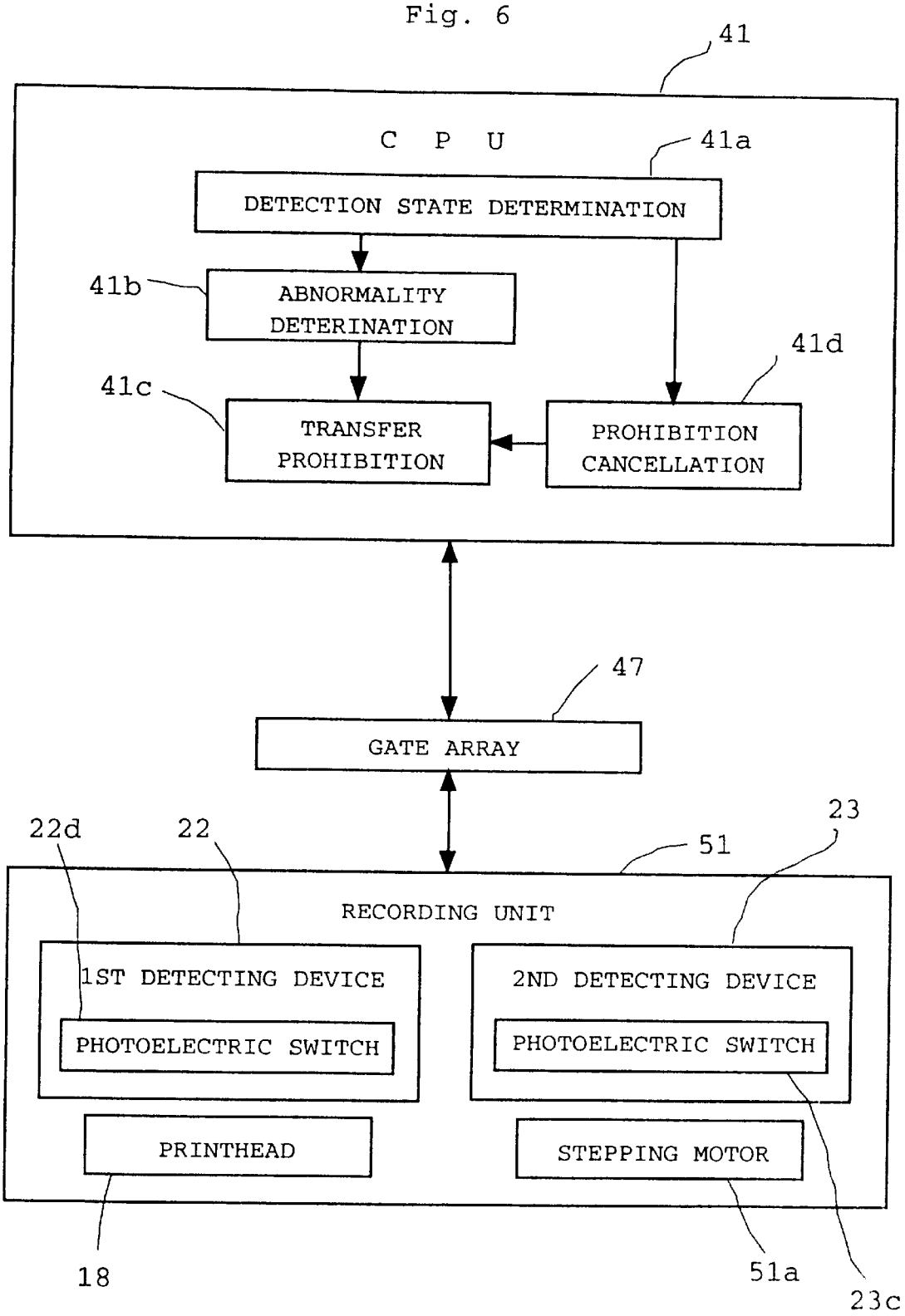
FIG. 6 is a block diagram showing the CPU and the printing unit incorporated in the circuitry of the facsimile machine.

The printing unit 51 performs printing of images on each recording paper 9 (FIG. 4) on the basis of the image data received through the gate array 47. As shown in FIG. 6, the printing unit 51 includes a stepping motor 51*a* for synchronously driving the feed roller 16, the platen roller 19 and one of the discharge rollers 21*a*, 21*b*. Further, the printing unit 51 also includes the printhead 18, the first detecting device 22 and the second detecting device 23, as already described.

Returning to FIGS. 1, 2 and 5, the operation unit 52 has key switches mounted on the front panel 5 to be operated by the user for output of operation signals, whereas the display unit 53 includes an LCD or the like also mounted on the front panel 5 for providing various indications under the control of the CPU 41.

As also shown in FIG. 6, the CPU 41 receives the detection signals from the respective photoelectric switches 22*d*, 23*c* of the first and second detecting devices 22, 23 through the gate array 47 while also receiving the stepping count signals from the stepping motor 51*a*. Operating under the program read out from the ROM 45, the CPU 41 also sends control signals for driving the printhead 18 and the stepping motor 51*a* as required for suitable printing and paper feed.

According to the illustrated embodiment, the CPU 41 controls the stepping motor 51*a* of the printing unit 51 in such a manner as to prohibit paper transfer when a recording paper is jammed or when the recording paper discharge tray 12 is pivoted open while canceling such paper transfer prohibition when the cause for the paper transfer prohibition is eliminated. For this purpose, the CPU 41 includes a detection state determiner 41*a* for determining whether the first detecting device 22 is in a paper transfer detection state or in a tray position detection state, an abnormality determiner 41*b* for determining that some abnormality has occurred when the recording paper 9 is jammed or when the recording paper discharge tray 12 is pivoted open, a transfer prohibitor 41*c* for prohibiting the stepping motor 51*a* from rotating upon detection of the abnormality, and a prohibition canceler 41*d* for allowing the stepping motor 23*c* to rotate after the cause for the motor drive prohibition is eliminated. Such paper feed control function of the CPU 41 is more specifically described below with reference to the flow diagrams of FIGS. 7 and 8.

Figure 7:
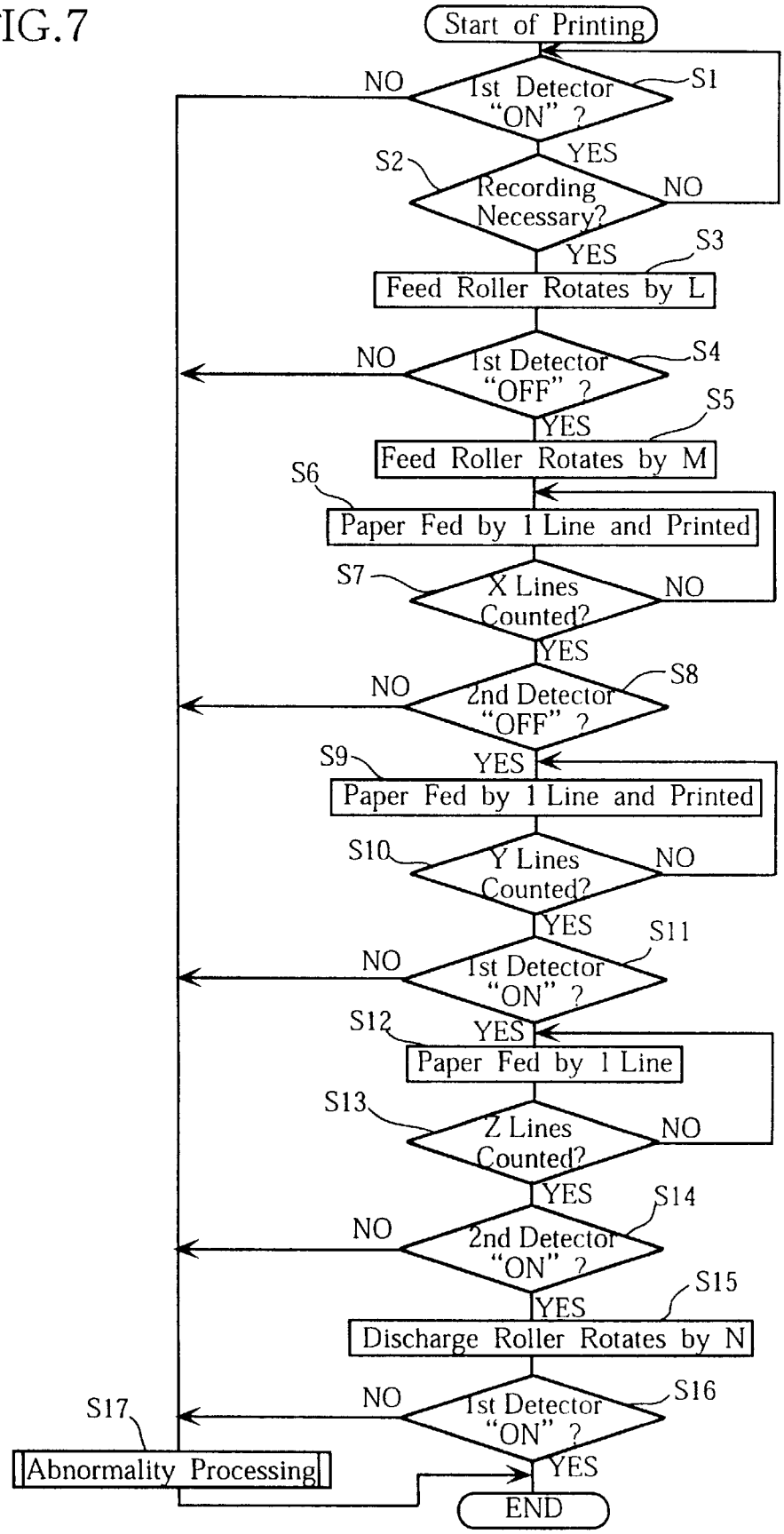
FIG. 7 is a flow diagram showing the process flow of the printing operation.

Referring first to FIG. 7, when the recording or printing process, which is repeated cyclically, is started, the CPU 41 first determines whether the detection signal from the first detecting device 22 (i.e., the photoelectric switch 22*d*) is "ON" (Step S1).

If "YES" in Step S1, the CPU 41 then determines whether the printing unit 51 needs to be operated for printing (Step S2). Specifically, the CPU 41 determines whether it has received image data, in the facsimile reception mode or the copying mode, for printing on the recording paper 9. At this time, since the detection signal from the first detecting device 22 is "ON" from the very start, the detection state determiner 41*a* of the CPU 41 has determined that the first detecting device 22 is in the paper transfer detection state because the detection signal from the first detecting device 22 should be "OFF" from the very start if the recording paper discharge tray 12 is pivoted open.

If "YES" in Step S2, the CPU 41 causes the stepping motor 51*a* of the printing unit 51 to rotate the feed roller 16 by an amount L, thereby advancing the recording paper 9 by a predetermined amount (Step S3). The rotational amount L of the feed roller 16 corresponds to the moving distance of the recording paper 9 from an initial position of the paper leading edge to a first detecting position at which the paper leading edge causes the first lever 22*a* to pivot to its OFF-position (see FIG. 9). This rotational amount L of the feed roller 16 is stored in the EEPROM 46 as a preset step count of the stepping motor 51*a*.

Then, the CPU 41 determines whether the first detecting device 22 is "OFF" (Step S4).

If "YES" in Step S4, the CPU 41 causes the stepping motor 51*a* of the printing unit 51 to rotate the feed roller 16 by an amount M, thereby advancing the recording paper 9 by a predetermined amount (Step S5). The rotational amount M of the feed roller 16 corresponds to the moving distance of the recording paper 9 from the above-mentioned first detecting position to an initial printing position at which the printing start position of the recording paper 9 contacts the print position of the printhead 18. This rotational amount M of the feed roller 16 is also stored in the EEPROM 46 as a preset step count of the stepping motor 51*a*.

Then, the CPU 41 controls the stepping motor 51*a* to drive the feed roller 16 and the platen roller 19 for advancing the recording paper 9 by one line while also controlling the printhead 18 to print a one-line image fragment on the recording paper 9 (Step S6). The printing operation is performed by repeating such a step.

In the course of such printing, the CPU 41 counts the number of lines by which the recording paper 9 is advanced, and causes the RAM 43 to memorize the counted number of lines. The line counting continues up to Step S14 to be later described.

Then, the CPU 41 determines whether the counted number of lines in the RAM 43 reaches a predetermined X count (Step S6). The X line count corresponds to the moving distance of the recording paper 9 from the above-mentioned initial printing position to a second detecting position at which the paper leading edge causes the lever 23*a* of the second detecting device 23 to pivot to its OFF-position (see FIG. 9). The X line count is stored in the EEPROM 46 as a preset step count of the stepping motor 51*a*.

If "YES" in Step S7, the CPU 41 determines whether the detection signal from the second detecting device 23 (the photoelectric switch 23*c*) is "OFF" (Step S8). Naturally, if the recording paper 9 is properly advanced by the the feed roller 16 and the platen roller 19 (i.e., the stepping motor 51*a*), the leading edge of the recording paper 9 should have reached the lever 23*a* of the second detecting device 23, so that the respective detection signals from the first and second detecting devices 22, 23 should be equally "OFF".

If "YES" in Step S8, the CPU 41 controls the stepping motor 51*a* of the printing unit 51 to rotate the feed roller 16 and the platen roller 19 for advancing the recording paper 9 by one line (Step S9). Further, the CPU 41 also controls the printhead 18 to print a one-line image fraction on the recording paper 9. This step is repeated until all image fractions for one whole page are printed out.

Then, the CPU 41 determines whether the counted number of lines in the RAM 43 reaches a predetermined Y count (Step S10). The Y line count corresponds to the moving distance of the recording paper 9 from the above-mentioned initial printing position to a first ON-position at which the trailing edge of the recording paper 9 comes out of contact with the first lever 22*a* of the first detecting device 22. The Y line count is stored in the EEPROM 46 as a preset step count of the stepping motor 51*a*.

If "YES" in Step S10, the CPU 41 determines whether the detection signal from the first detecting device 22 (the photoelectric switch 22*d*) is "ON" (Step S11). Naturally, if the recording paper 9 is properly advanced by the feed roller 16, the platen roller 19 and the pair of discharge rollers 21*a*, 21*b* (i.e., the stepping motor 51*a* ), the trailing edge of the recording paper 9 should have come out of contact with the first lever 22*a* of the first detecting device 22, so that the detection signal from the first detecting device 22 should be "ON".

If "YES" in Step S11, the CPU 41 controls the stepping motor 51*a* of the printing unit 51 to rotate the platen roller 19 and the pair of discharge rollers 21*a*, 21*b* for advancing the recording paper 9 by one line (Step S12). At this time, if the printing operation has not finished yet, the CPU 41 further controls the printhead 18 for continuation of the printing operation.

Then, the CPU 41 determines whether the counted number of lines in the RAM 43 reaches a predetermined Z count (Step S13). The Z line count corresponds to the moving distance of the recording paper 9 from the above-mentioned initial printing position to a second ON-position at which the trailing edge of the recording paper 9 comes out of contact with the lever 23*a* of the second detecting device 23. The Z line count is stored in the EEPROM 46 as a preset step count of the stepping motor 51*a*.

If "YES" in Step S13, the CPU 41 determines whether the detection signal from the second detecting device 23 (the photoelectric switch 23*c*) is "ON" (Step S14). Naturally, if the recording paper 9 is properly advanced by the platen roller 19 and the pair of discharge rollers 21*a*, 21*b* (i.e., the stepping motor 51*a* ), the trailing edge of the recording paper 9 should have come out of contact with the lever 23*a* of the second detecting device 23, so that the detection signal from the second detecting device 23 should be "ON".

If "YES" in Step S14, the CPU 41 controls the stepping motor 51*a* of the printing unit 51 to rotate one of the discharge rollers 21*a*, 21*b* (i.e., the drive discharge roller 21*b*) by an amount N, thereby advancing the recording paper 9 by a predetermined amount (Step S15). The rotational amount N of the drive discharge roller 21*b* corresponds to the moving distance of the recording paper 9 from the above-mentioned second ON-position to a paper discharge position at which the trailing edge of the recording paper 9 is discharged out of the rear cover 4 through the recording paper outlet 13. This rotational amount N of the drive discharge roller 21*b* is also stored in the EEPROM 46 as a preset step count of the stepping motor 51*a*.

Then, the CPU 41 again determines whether the detection signal from the first detecting device 22 is "ON" (Step S16).

If "YES" in Step S16, the printing routine terminates. In this state, the recording paper 9 having undergone complete printing has been properly discharged, whereas the recording paper discharge tray 12 is kept pivoted to its closed position.

If the detection signal from the first detecting device 22 is "OFF" in Step S16 ("NO" in Step S16), the CPU 41 performs an abnormality process S17 and terminates the printing routine. The abnormality at this time is considered attributable to the fact that the user may have pivoted the recording paper discharge tray 12 to its open position.

If the detection signal from the second detecting device 23 remains "OFF" in Step S14 ("NO" in Step S14), the CPU 41 performs the abnormality process S17 and terminates the printing routine. At this time, the abnormality may have occurred due to a paper jam in the paper transfer path from the platen roller 19 to the pair of discharge rollers 21*a*, 21*b*.

If the counted number of lines in the RAM 43 has not reached the z line count in Step S13 ("NO" in Step S13), Step 12 is repeated.

If the detection signal from the first detecting device 22 is "OFF" in Step S11 ("NO" in Step S11), the CPU 41 performs the abnormality process S17 and terminates the printing routine. At this time, the abnormality may have occurred due to a paper jam in the paper transfer path from the feed roller 16 to the pair of discharge rollers 21*a*, 21*b*.

If the counted number of lines in the RAM 43 has not reached the Y line count in Step S10 ("NO" in Step S10), Step 9 is repeated for causing the printhead 18 to print out an additional one-line image fraction on the recording paper which is synchronously advanced by an additional one line by the platen roller 19.

If the detection signal from the second detecting device 23 is "ON" in Step S8 ("NO" in Step S8), the CPU 41 performs the abnormality process S17 and terminates the printing routine. At this time, the abnormality may have occurred due to a paper jam in the paper transfer path from the feed roller 16 to the lever 23*a* of the second detecting device 23.

If the counted number of lines in the RAM 43 has not reached the X line count in Step S7 ("NO" in Step S7), Step 6 is repeated for causing the printhead 18 to print out an additional one-line image fraction on the recording paper which is synchronously advanced by an additional one line by the platen roller 19.

If the detection signal from the first detecting device 22 is "ON" in Step S4 ("NO" in Step S4), the CPU 41 performs the abnormality process S17 and terminates the printing routine. At this time, the abnormality may have occurred due to a paper jam in the paper transfer path from the feed roller 16 to the first lever 22*a* of the first detecting device 22.

If, in Step S2, the CPU 41 finds it unnecessary to perform a printing operation ("NO" in Step S2), Step S1 is repeated.

Thus, before the printing unit 51 becomes ready for printing, the CPU 41 constantly monitors the presence (or absence) of the recording paper 9 at the first detecting device 22 while also watching the pivotal position of the recording paper discharge tray 12.

In Step S1, if the detection signal from the first detecting device 22 is "OFF" ("NO" in Step S1), the CPU 41 performs the abnormality process S17. At this time, the abnormality may have occurred due to a pivotal movement of the recording paper discharge tray 12 from the closed position (FIGS. 4 and 9) to the open position (FIG. 10), and the detection state determiner 41*a* of the CPU 41 recognizes this from the fact that the detection signal from the first detecting device 22 is "OFF" even under no paper feed.

Figure 8:
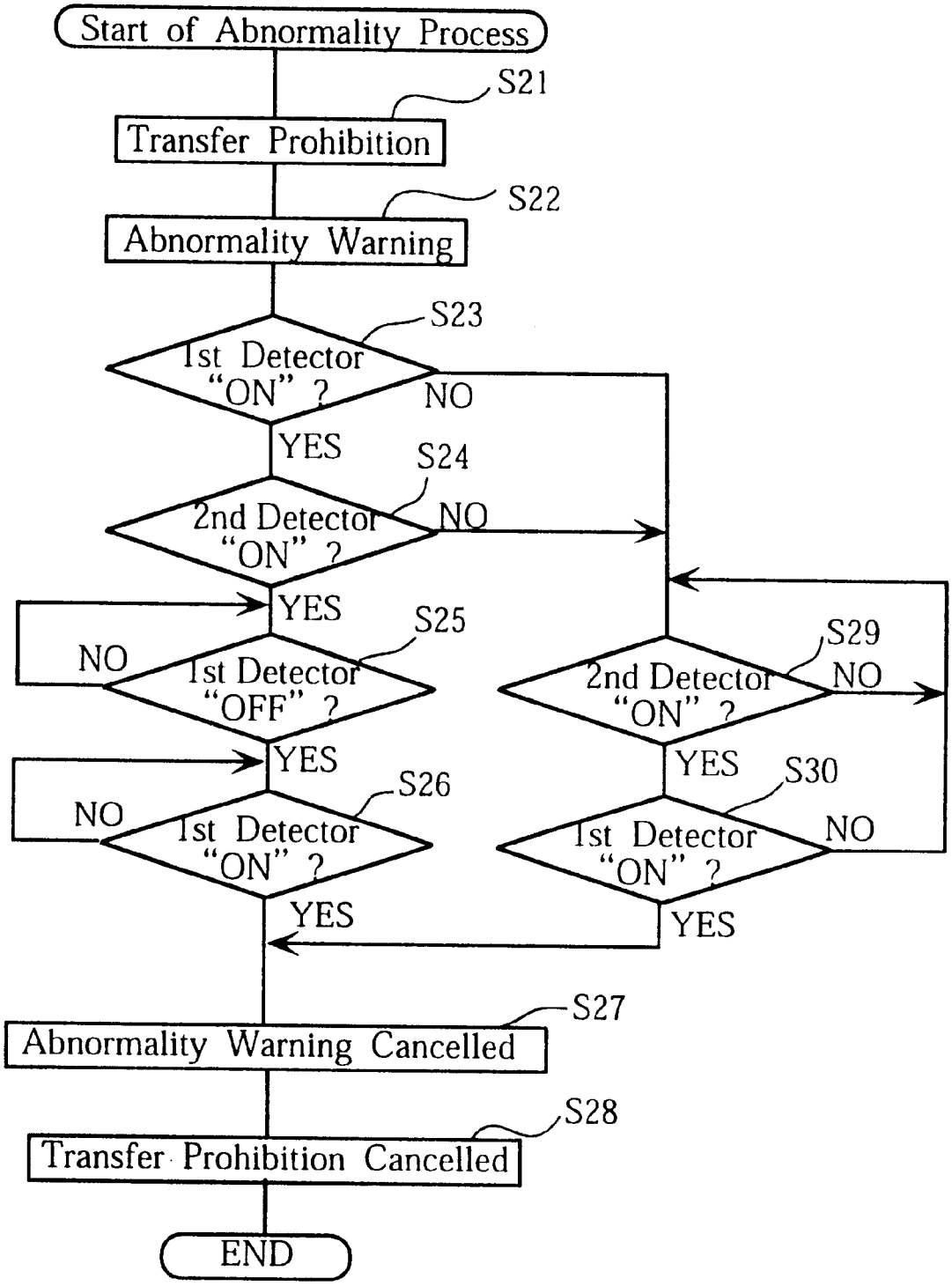
FIG. 8 is a flow diagram showing the flow of the abnormality process.

Next, the abnormality process S17 is described with reference to the block diagram of FIG. 6 and the flow diagram of FIG. 8.

When an abnormality is detected by the abnormality determiner 41*b* of the CPU 41, the transfer prohibitor 41*c* causes the stepping motor 51*a* (i.e., the feed roller 16, the platen roller 19 and the drive discharge roller 21*b*) to stop, thereby prohibiting transfer of the recording paper 9 (Step S21). If the stepping motor 51*a* is already in stoppage, this state is maintained.

On the other hand, the abnormality determiner 41*b* also functions to make a warning indication at the front operation/display panel 5 (FIGS. 1 and 2) for notifying the user of the detected abnormality (Step S22).

Then, the prohibition canceler 41*d* of the CPU 41 determines whether the detection signal from the first detecting means 22 is "ON" (Step S23).

If "YES" in Step S23, the prohibition canceler 41*d* of the CPU 41 then determines whether the detection signal from the second detecting means 23 is "ON" (Step S24).

If "YES" in Step S24, it is considered that the abnormality may have occurred due to a paper jam before the leading edge of the recording paper 9 reaches the first lever 22*a* of the first detecting device 22. Alternatively, the abnormality may have occurred due to a paper running-out at the recording paper insertion space 14. In either case, elimination of the abnormality requires pivotally opening the recording paper discharge tray 12 (FIG. 10) for removing the jammed paper or for introducing a new stack of recording papers into the recording paper insertion space 14.

Thus, in Step S25 following the "YES"-branch of Step S24, the prohibition canceler 41*d* of the CPU 41 determines whether the detection signal from the first detecting means 22 is "OFF". This process step is necessary to confirm that the user has pivotally opened the recording paper discharge tray 12 for eliminating the cause for the abnormality.

If "YES" in Step S25, the prohibition canceler 41*d* of the CPU 41 again determines whether the detection signal from the first detecting means 22 is "ON" (Step S26). This process step is necessary to confirm that the user has pivotally closed the recording paper discharge tray 12 after eliminating the cause for the abnormality.

If "YES" in Step S26, the prohibition canceler 41*d* of the CPU 41 cancels the abnormality warning indication at the front operation/display panel 5 (Step S27). Further, the prohibition canceler 41*d* also causes the transfer prohibition means 41*c* to cancel the previous transfer prohibition (Step S28). As a result, the stepping motor 51*a* may be driven to transfer the recording paper 9 when the printing operation resumes.

If the detection signal from the first detecting device 22 is "OFF" in Step S26 ("NO" in Step S26), the prohibition canceler 41*d* waits until the detection signal received in Step S26 changes to "ON".

If the detection signal from the first detecting device 22 is "ON" in Step S25 ("NO" in Step S25), the prohibition canceler 41*d* waits until the detection signal received in Step S25 changes to "OFF".

If the detection signal from the second detecting device 23 is "OFF" in Step S24 ("NO" in Step S24), it is considered that a paper jam may have occurred after the recording paper 9 have completely passed beyond the first lever 22*a* of the first detecting device. Unless the user removes the cause for the abnormality (i.e., the jammed paper), the detection signal from the second detecting device 22 remains "OFF".

Thus, in Step S29 following the "NO"-branch of Step S24, the prohibition canceler 41*d* determines whether the detection signal from the second detecting device 23 has changed to "ON" due to the user's removal of the jammed paper.

If "YES" in Step S29, the prohibition canceler 41*d* of the CPU 41 then determines whether the detection signal from the first detecting device 22 is "ON" (Step S30).

If "YES" in Step S30, the abnormality process proceeds to Step S27 followed by Step S28, as previously described.

If "NO" in Step S30, the process returns to Step S29, and the prohibition canceler 41*d* waits until the detection signals from both of the first and detecting devices 22 becomes equally "ON".

If "NO" in Step S29, the prohibition canceler 41*d* waits until the detection signal from the second detecting device 23 changes to "ON".

If the detection signal from the first detecting device 22 is "OFF" in Step S23 ("NO" in Step S23), the abnormality process proceeds to Step S29 which is previously described.

In the abnormality process, at least one of the first and second detecting devices 22, 23 generates an OFF-signal unless the recording paper 9 is jammed before reaching the first lever 22*a* of the first detecting device 22 or no paper is present in the recording paper insertion space 14. Thus, if the user eliminates the cause for the abnormality by removing the jammed recording paper and/or by pivoting the recording paper discharge tray 12 to its closed position, both of the first and second detecting devices 22, 23 become equally "ON". This is why the paper transfer prohibition is canceled if both of the first and second devices 22, 23 are confirmed to be equally "ON" in Steps S29 and S30.

As appreciated from the foregoing description, the first detecting device 22 can be utilized dually for detecting the transfer state of the recording paper 9 and for detecting the pivotal state of the recording paper discharge tray 12 which forms a part of the recording paper receiver 10 (see FIG. 4), and the detection state determiner 41*a* of the CPU 41 can determine whether the first detecting device 22 is being used for detecting the paper transfer state or for the tray pivotal state. Thus, it is unnecessary to provide a separate detector for exclusively detecting the pivotal state of the recording paper discharge tray 12, thereby reducing the cost of the sheet transfer apparatus (i.e., the facsimile machine incorporating the same).

Further, since the pivotal movement of the recording paper discharge tray 12 operatively connected to the first detecting device 22 provides an easy access to the recording paper receiver 10, the recording paper jammed at or near the feed roller 16 may be easily removed simply by pivotally opening the recording paper discharge tray 12, so that the rear cover 4 (FIGS. 1–3) as a whole need not be opened.

According to the illustrated embodiment, the first detecting device is provided upstream from the printhead 18, whereas the second detecting device is provided downstream from the printhead 18. Thus, it is possible to reliably detect the paper transfer state from the very start to the end of printing.

Further, according to the illustrated embodiment, the paper transfer prohibition at the time of abnormality is automatically canceled simply by removing the jammed recording paper 9 and/or by pivotally closing the recording paper discharge tray 12. Thus, it is unnecessary to perform a special step of canceling the paper transfer prohibition such as pushing a reset button.

Figure 9:
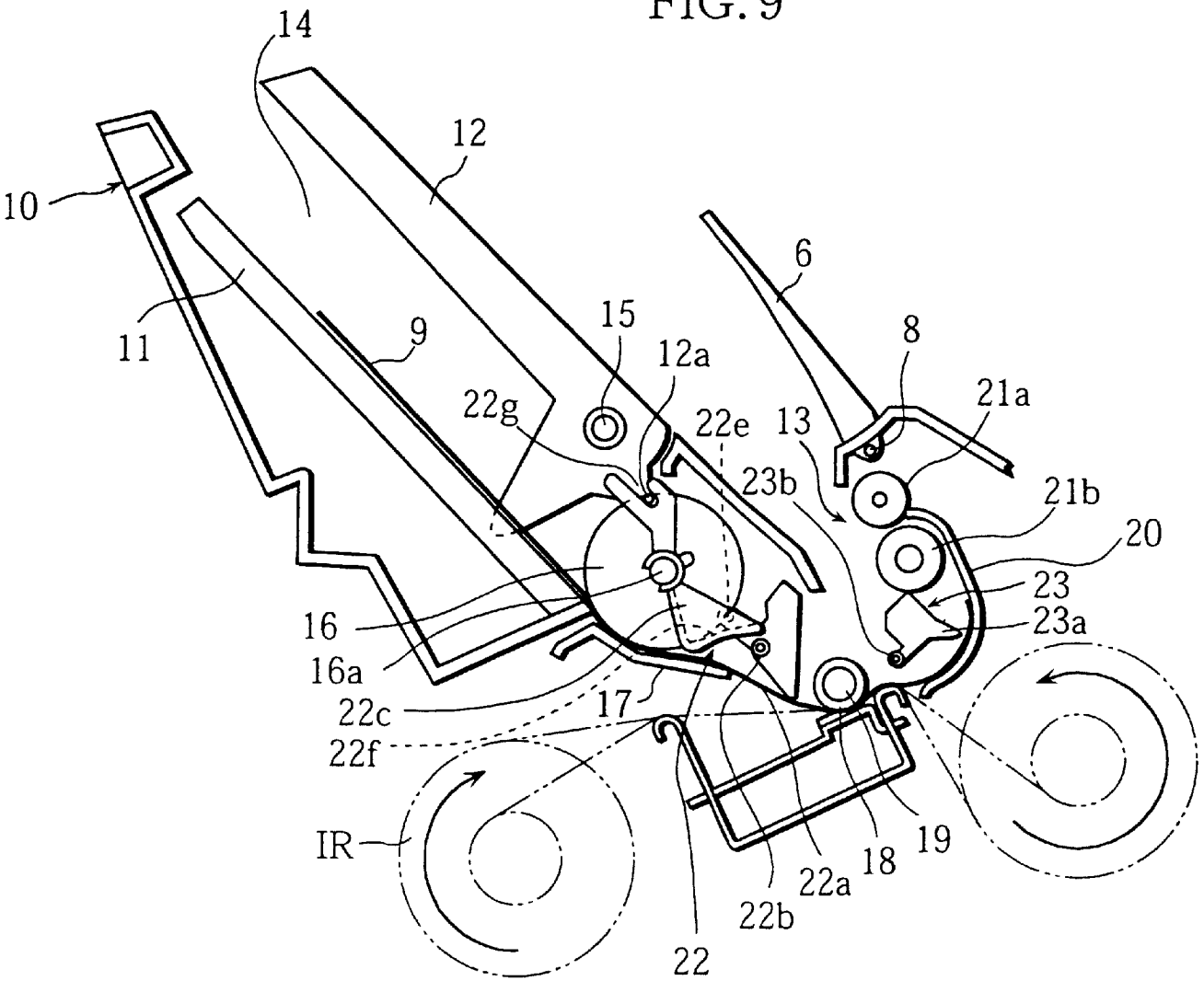
FIG. 9 is a schematic view similar to FIG. 4 but showing the same sheet transfer apparatus in its state for sheet transfer.

Further, as shown in FIG. 9, when the first lever 22*a* of the first detecting device 22 is pivoted to its ON-position by the transferred recording paper 9, the engaging pin 22*e* carried by the first lever 22*a* is located at such a position as to prevent counterclockwise rotation of the second lever 22*c* of the first detecting device 22. Thus, once the transfer of the recording paper 9 starts, the recording paper discharge tray 12 is effectively prevented from being unexpectedly pivoted open.

The present invention being thus described, it is obvious that the same may be varied in many other ways. For instance, the present invention may be applied not only to the transfer apparatus for the recording paper 9 but also to the transfer apparatus for the document paper. Further, the printhead 18, which is a thermal transfer ink ribbon type printhead, may be replaced by any other type of printhead such as an ink jet printhead. Moreover, the recording paper discharge tray 12, which is operatively connected to the first detecting device 22 in the illustrated embodiment, may be operatively connected to the second detecting device 23 instead. Such variations should not be regarded as a departure from the spirit and scope of the present invention, and all such modifications as would be obvious to those skilled in the art are intended to be included within the scope of the following claims.

I claim:

1. A sheet transfer apparatus comprising:

a sheet receiver for receiving a sheet, the sheet receiver including an openable member which is movable between an open position and a closed position;

a transfer mechanism for transferring the sheet from the sheet receiver along a predetermined transfer path;

a common detecting device provided at a predetermined position in the transfer path for detecting a transfer state of the transferred sheet and for detecting an open/closed state of the openable member; and a controller for determining whether the detecting device is detecting the transfer state of the transferred sheet or the open/closed state of the openable member.

2. The sheet transfer apparatus according to claim 1, wherein the detecting device comprises:

a first lever pivotally supported for engagement with the transferred sheet;

a second lever pivotally supported for engagement with the first lever and the openable member; and a switch associated with the first lever for turning on and off in response to pivotal movement of the first lever.

3. The sheet transfer apparatus according to claim 2, wherein the first lever carries an engaging pin, the second lever having a guide wall for engagement with the engaging pin of the first lever, the engaging pin preventing pivotal movement of the second lever when the first lever is first pivoted by the transferred sheet.

4. The sheet transfer apparatus according to claim 1, wherein the openable member is a sheet discharge tray which is pivotable between the open position and the closed position, the sheet receiver including a sheet feed tray which defines a sheet insertion space in combination with the sheet discharge tray which is pivoted to the closed position.

5. The sheet transfer apparatus according to claim 1, wherein the controller comprises:

an abnormality determiner for detecting an abnormality on the basis of a detection signal from the detecting device and a drive state of the transfer mechanism;

a transfer prohibitor for prohibiting the transfer mechanism from operating when the abnormality determiner detects the abnormality; and a prohibition canceler for allowing the transfer mechanism to operate upon closing the openable member after removal of a cause for the abnormality.

6. The sheet transfer apparatus according to claim 1, wherein the sheet receiver is capable of receiving a plurality of sheets.

7. The sheet transfer apparatus according to claim 1, wherein the sheet transfer apparatus is incorporated in a facsimile machine.

8. A sheet transfer apparatus comprising:

a sheet receiver for receiving a sheet, the sheet receiver including an openable member which is movable between an open position and a closed position;

a transfer mechanism for transferring the sheet from the sheet receiver along a predetermined transfer path, the transfer mechanism including a platen roller provided at an intermediate position of the transfer path;

a first detecting device provided in the transfer path upstream from the platen roller for detecting a transfer state of the transferred sheet, the first detecting device being connected to the openable member for detecting an open/closed state of the openable member;

a second detecting device provided in the transfer path downstream from the platen roller for detecting a transfer state of the transferred sheet; and a controller for detecting an abnormality on the basis of detection signals from the first and second detecting devices and a drive state of the transfer mechanism, the controller prohibiting the transfer mechanism from operating upon detection of the abnormality, the controller further allowing the transfer mechanism to operate upon closing the openable member after removal of a cause for the abnormality.

9. The sheet transfer apparatus according to claim 8, wherein the first detecting device comprises:

a first lever pivotally supported for engagement with the transferred sheet upstream from the platen roller;

a second lever pivotally supported for engagement with the first lever and the openable member; and a switch associated with the first lever for turning on and off in response to pivotal movement of the first lever.

10. The sheet transfer apparatus according to claim 9, wherein the first lever carries an engaging pin, the second lever having a guide wall for engagement with the engaging pin of the first lever, the engaging pin preventing pivotal movement of the second lever when the first lever is first pivoted by the transferred sheet.

11. The sheet transfer apparatus according to claim 8, wherein the second detecting device comprises:

a single lever pivotally supported for engagement with the transfer sheet downstream from the platen roller; and a switch associated with the lever for turning on and off in response to pivotal movement of the lever.

12. The sheet transfer apparatus according to claim 8, wherein the openable member is a sheet discharge tray which is pivotable between the open position and the closed position, the sheet receiver including a sheet feed tray which defines a sheet insertion space in combination with the sheet discharge tray which is pivoted to the closed position.

13. The sheet transfer apparatus according to claim 8, wherein the controller comprises detection state determiner for determining whether the first detecting device is detecting the transfer state of the transferred sheet or the open/closed state of the openable member.

14. The sheet transfer apparatus according to claim 8, wherein the controller is a central processing unit of a facsimile machine.

15. The sheet transfer apparatus according to claim 14, wherein the sheet transfer apparatus is incorporated in the facsimile machine.

16. A sheet transfer apparatus comprising:

a sheet receiver for receiving a sheet, the sheet receiver including an openable member which is movable between an open position and a closed position;

a transfer mechanism for transferring the sheet from the sheet receiver along a predetermined transfer path;

a first detecting device for detecting an open/closed state of the openable member;

a second detecting device for detecting a transfer state of the transferred sheet; and a controller for detecting an abnormality on the basis of detection signals from the first and second devices and a drive state of the transfer mechanism, the controller prohibiting the transfer mechanism from operating upon detection of the abnormality, the controller further allowing the transfer mechanism to operate upon closing the openable member after removal of a cause for the abnormality.

17. The sheet transfer apparatus according to claim 16, wherein the first detecting device comprises:

a first lever pivotally supported for engagement with the transferred sheet;

a second lever pivotally supported for engagement with the first lever and the openable member; and a switch associated with the first lever for turning on and off in response to pivotal movement of the first lever;

whereby the first detecting device also detects the transfer state of the transferred sheet in addition to detecting the open/closed state of the openable member.

18. The sheet transfer apparatus according to claim 17, wherein the first lever carries an engaging pin, the second lever having a guide wall for engagement with the engaging pin of the first lever, the engaging pin preventing pivotal movement of the second lever when the first lever is first pivoted by the transferred sheet.

19. The sheet transfer apparatus according to claim 16, wherein the second detecting device comprises:

a single lever pivotally supported for engagement with the transfer sheet; and a switch associated with the lever for turning on and off in response to pivotal movement of the lever.

20. The sheet transfer apparatus according to claim 16, wherein the openable member is a sheet discharge tray which is pivotable between the open position and the closed position, the sheet receiver including a sheet feed tray which defines a sheet insertion space in combination with the sheet discharge tray which is pivoted to the closed position.

* * * * *